United States Patent [19]

Allo et al.

[11] Patent Number: 4,519,448

[45] Date of Patent: May 28, 1985

[54] FALLING FILM HEAT EXCHANGER WITH MEMBER TO DISTRIBUTE LIQUID ON EXTERNAL SURFACES OF TUBES

[75] Inventors: Vincent F. Allo, Warrenville; Donald C. Stafford, Hinsdale, both of Ill.

[73] Assignee: Chicago Bridge & Iron Company, Oak Brook, Ill.

[21] Appl. No.: 494,937

[22] Filed: May 16, 1983

[51] Int. Cl.[3] ..... F28D 3/04

[52] U.S. Cl. ..... 165/118; 62/310; 62/314; 165/DIG. 19; 261/112; 261/153

[58] Field of Search ..... 165/115, 118, DIG. 19; 62/314, 304, 305, 310; 261/153, 112

[56] References Cited

U.S. PATENT DOCUMENTS

| | | | |
|---|---|---|---|
| 1,639,857 | 8/1927 | Planski | 165/118 |
| 1,694,370 | 12/1928 | Burdick | 165/118 X |
| 1,830,093 | 11/1931 | Daniels | 165/115 X |
| 2,189,146 | 2/1940 | Little | 165/118 X |
| 4,286,436 | 9/1981 | Engdahl et al. | 62/123 |

FOREIGN PATENT DOCUMENTS

| | | | |
|---|---|---|---|
| 913782 | 5/1954 | Fed. Rep. of Germany | 165/115 |

*Primary Examiner*—Sheldon J. Richter

*Attorney, Agent, or Firm*—Marshall, O'Toole, Gerstein, Murray & Bicknell

[57] ABSTRACT

A falling film heat exchanger having a plurality of tubes is provided with a liquid distribution member surrounding each tube which directs liquid against the tube external wall to control the falling film flow and to form uniform films on each tube. The liquid can be a feed liquid or a heat exchange liquid such as a refrigerant.

6 Claims, 4 Drawing Figures

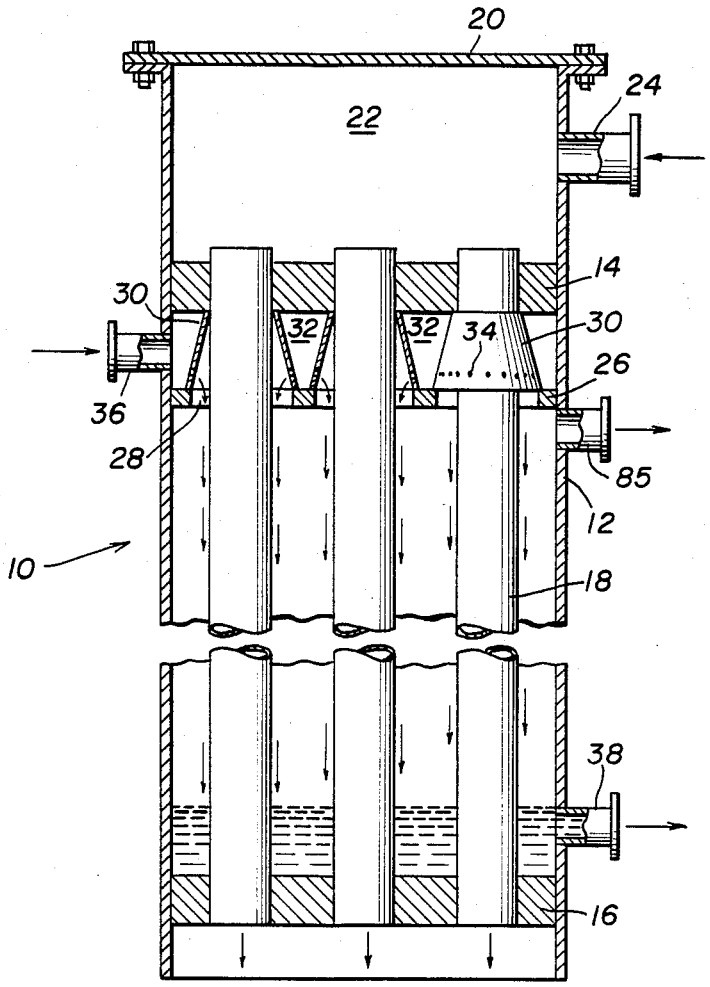
FIG. 1
FIG. 2
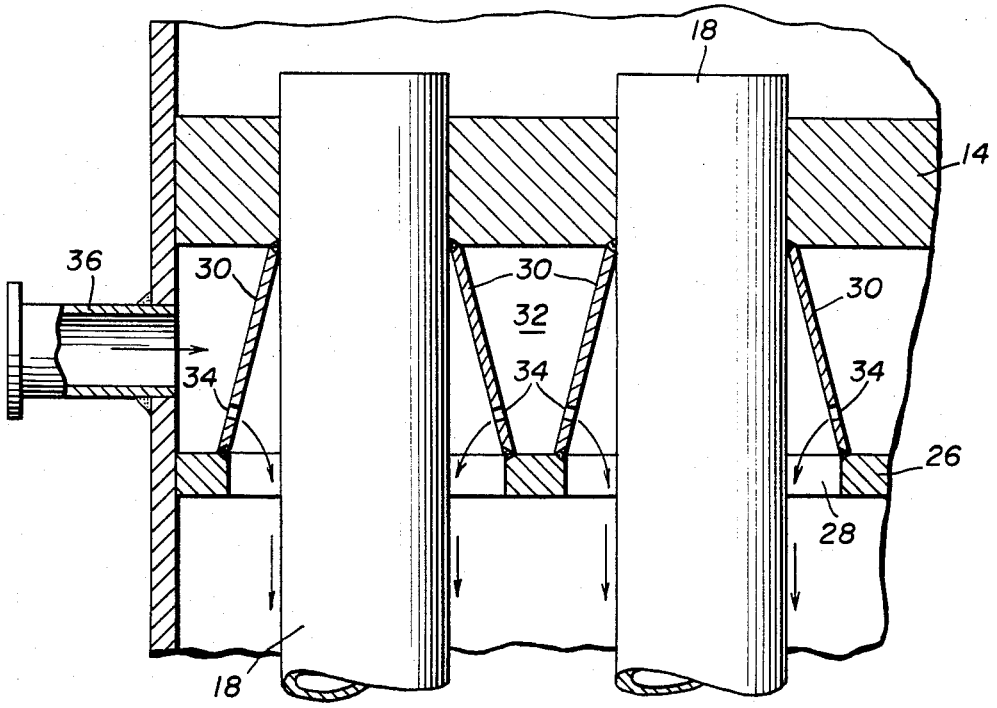

FALLING FILM HEAT EXCHANGER WITH MEMBER TO DISTRIBUTE LIQUID ON EXTERNAL SURFACES OF TUBES

This invention relates to vertical falling film heat exchangers containing tubes. More particularly, this invention is concerned with an improved heat exchanger which has a liquid distribution member around a portion of the tubes to direct a liquid against the outer surfaces of the tubes to form a thin falling film, thereby increasing heat exchange.

BACKGROUND OF THE INVENTION

Falling film heat exchangers usually include an array of vertical tubes. The tubes can be exposed or surrounded by a shell. The process liquid can be either inside or outside the tube with the heat exchange fluid on the other side.

Although falling film heat exchangers are often used to heat a liquid feed stream, they can be used for cooling such a stream. Falling film heat exchangers of the described types can be used as freeze exchangers for producing fresh water from brackish water and seawater, for concentrating fruit and vegetable juices, and industrial crystallization processes. See U.S. Pat. No. 4,286,436. As the liquid flows through each tube, it can be cooled enough to crystallize a solid from the liquid. Thus, by cooling seawater, ice is obtained which when separated, washed and melted provides potable water. When a fruit or vegetable juice is similarly chilled, ice forms and is removed to provide a concentrated juice.

Freeze exchangers of the described type can use any cooling fluid to cool a liquid flowing downwardly on the tubes. Some suitable cooling fluids are refrigerant gases such as ammonia and Freon brand refrigerants.

Whether the heat exchanger is used to heat or cool a process or feed liquid, it is desirable to be able to control the thickness and uniformity of the falling film on each tube. Generally, acceptable results are not obtained by simply supplying enough liquid to flow down each tube because the feed to each tube is most often nonuniform, with some tubes receiving much more, and others much less, liquid than desired for optimum heat exchange results. There is a need, accordingly, for apparatus which will facilitate supplying the refrigerant and/or process or feed liquid to the tubes to produce falling films uniformly thick and evenly distributed on the surface of each tube.

SUMMARY OF THE INVENTION

According to one embodiment of the invention there is provided a falling film heat exchanger comprising a shell connected to vertically spaced apart horizontally arranged circular upper and lower tube sheets; a plurality of vertically positioned parallel tubes, with each tube extending through and sealingly connected to a hole in each tube sheet; a circular distribution plate spaced below the upper tube sheet and sealingly connected to the shell defining a heat exchange liquid distribution space, with said parallel tubes extending through oversized holes in the distribution plate; a heat exchange liquid distribution member surrounding each tube in the distribution space joined at a lower end to the distribution plate around said oversized hole and means preventing liquid from flowing between the member upper end and the tube, said member having means which directs liquid, in the distribution space, against the tube external wall and permits flow of liquid to the tube external wall only from said member; means to feed a heat exchange liquid to the distribution space and means to withdraw the heat exchange liquid from the shell side of the heat exchanger above the lower tube sheet; and a liquid distribution box positioned above the upper tube sheet and means to deliver a feed liquid to the liquid distribution box.

The member which directs liquid to the tube external wall can include plurality of spaced apart holes which are sized so that the downwardly flowing liquid spreads out and distributes as a continuous liquid layer on the tube external wall. The holes can be at an angle of about 0° to 80° measured from a plane horizontal to the tube axis. However, the holes are desirably at an angle of 20° to 80°, and preferably 40° to 70°.

The cooling liquid distribution member can be a truncated conical shell having its upper end sealingly joined to the upper tube sheet.

According to a second embodiment of the invention there is provided a heat exchanger comprising a vessel having a top, bottom and side wall enclosing a liquid feed box in the bottom portion, and a heat exchange liquid space in the top portion separated by a tube sheet; a plurality of heat exchange tubes, supported by the tube sheet, extending downwardly in the feed box and out through oversized holes larger than the tubes in the vessel bottom, said tubes being closed at their lower ends and having their upper ends in fluid communication with the heat exchange liquid space; a liquid feed distribution member surrounding each tube in the liquid feed box joined at a lower end to the vessel bottom around said oversized hole and means preventing liquid from flowing between the member upper end and the tube, said member having means which directs feed liquid, in the distribution space, against the tube external wall and permits flow of liquid to the tube external wall only from said member; means to deliver a liquid feed stream into the feed box; and means to deliver a heat exchange liquid to the heat exchange liquid space and means to remove heat exchange fluid therefrom.

According to this second embodiment the liquid distribution member which directs liquid to the tube external wall includes a plurality of spaced apart holes in the member which are sized so that the downwardly flowing liquid spreads out and distributes as a continuous liquid layer or film on the tube external wall. The holes can be at an angle of about 0° to 80° measured from a plane horizontal to the tube axis. Desirably, the holes are at an angle of 20° to 80°, and preferably 40° to 70°.

In this second embodiment, the feed liquid distribution member also can be a truncated conical shell having its upper end sealingly joined to the upper tube sheet.

BRIEF DESCRIPTION OF THE DRAWINGS

FIG. 1 is an elevational view, partially in section, of one embodiment of a falling film heat exchanger according to the invention;

FIG. 2 is an enlarged view of the liquid feed distribution system in the heat exchanger shown in FIG. 1;

DETAILED DESCRIPTION OF THE DRAWINGS

To the extent it is reasonable and practical, the same or similar elements or parts which appear in the various views of the drawings will be identified by the same numbers.

Figure 3:
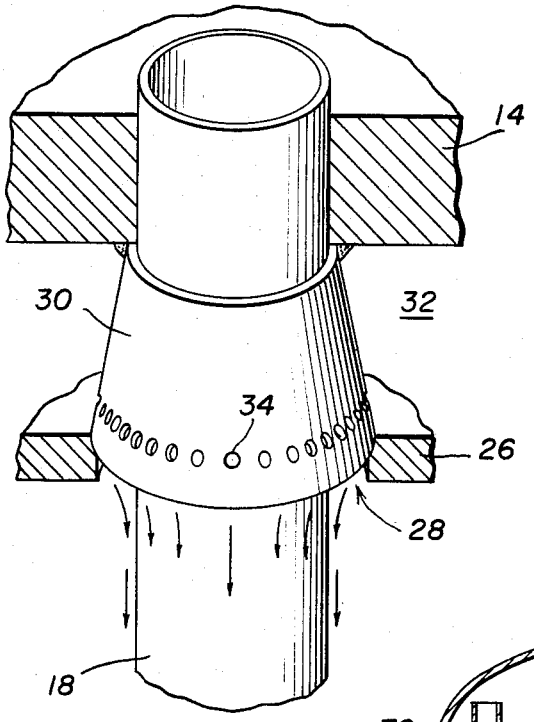
FIG. 3 is an isometric view of the liquid feed distribution member, around a heat exchange tube, shown in FIGS. 1 and 2.

With reference to FIGS. 1 to 3, the falling film heat exchanger 10 has a shell 12 connected to vertically spaced apart horizontally arranged circular upper and lower tube sheets 14 and 16. A plurality of vertically positioned parallel heat exchange tubes 18 extend through and are sealed to holes in the tube sheets 14 and 16 so that fluid cannot flow by. Shell 12 extends above upper tube sheet 14 and supports removable cover 20. That portion of shell 12 extending above upper tube sheet 14 and supporting cover 20 defines a feed liquid supply box 22. Inlet conduit 24 is provided for feeding liquid to the supply box 22.

Spaced below upper tube sheet 14 is a circular distribution plate 26 which is sealingly joined to shell 12. Distribution plate 26 contains an oversized hole 28 for each tube 18 to extend through.

A truncated conical shell liquid refrigerant distribution member 30 is positioned around each portion of each tube 18 in the refrigerant distribution space 32 between upper tube sheet 14 and distribution plate 26. Each distribution member 30 has its base welded to distribution plate 26 around a hole 28. Similarly, the top and smaller end of member 30 is welded to the lower surface of upper tube sheet 14. The top of member 30 contains a hole only big enough for a tube 18 to slide through it.

Each distribution member 30 contains a plurality of radially positioned, spaced apart holes 34 located at an angle of about 30° to 40° from a plane horizontal to the axis of tube 18. The number and size of the tubes is predetermined so as to have the refrigerant flowing through them contact tube 18 and then flow downwardly while spreading out on the tube to produce a falling film completely surrounding the tube circumference.

Inlet conduit 36 provides for a liquid refrigerant, such as ammonia, to be fed to distribution space 32. Similarly, outlet conduit 38 is provided to remove excess refrigerant liquid from the lower shell side of the heat exchanger. Outlet 85 is provided to remove excess refrigerant vapor.

As feed liquid is supplied to supply box 22 it flows downwardly through tubes 18 as a falling film. Simultaneously, a liquid refrigerant falling film flows downwardly on the outside surface of each tube 18 thereby cooling the feed liquid. If the feed liquid is an aqueous solution or dispersion, part of the water is converted to ice. The mixture or slurry of ice and solution flows out of the lower ends of tubes 18 into a collecting tank, not shown. The ice can then be separated and the remaining solution returned to the supply box 22 for further treatment as described. When the tubes 18 are about two inches in diameter, about ten to sixteen holes 34 can be used in each member 30 and the holes can be about 0.05 to 0.15 inch in diameter. It should also be understood that the rate of flow through the holes can be regulated by the depth of feed liquid in space 32 as well as the pressure therein. While the holes are shown as circular, they can also be square, triangular, rectangular and oval. They can be arranged in rows and columns as appropriate.

Figure 4:
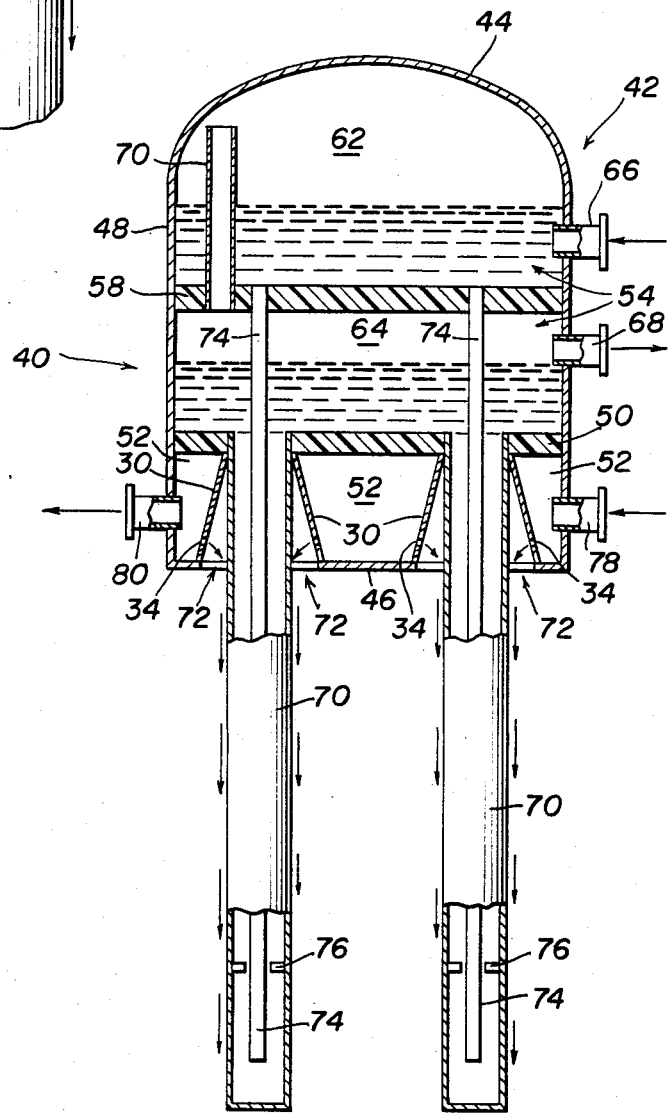
FIG. 4 is primarily a vertical sectional view, although partially broken away, of a second embodiment of heat exchanger according to the invention.

FIG. 4 illustrates a second embodiment of falling film freeze exchanger according to the invention. However, in this embodiment the feed liquid, instead of the liquid refrigerant, is distributed as a falling film on the outside of the tubes. The freeze exchanger 40 includes a vessel 42 having a top 44, liquid feed distribution bottom 46 and side wall 48. Lower tube sheet 50 divides the vessel 42 interior into a liquid feed box space 52 in the bottom portion and a cooling fluid space 54 in the top portion.

An upper tube sheet 58 is positioned in vessel 42 and divides the cooling liquid box space 52 into an upper space 62 and a lower space 64. Conduit 66 feeds a liquefied refrigerant gas to upper space 62 and conduit 68 removes it therefrom. Tube 70 extends upwardly from second tube sheet 58 to provide vapor communication between upper space 62 and lower space 64.

A plurality of freeze tubes 70, joined near their top ends to lower tube sheet 50, extend downwardly through oversized holes 72 in the bottom 46. The clearance between holes 72 and tubes 70 provides space for a film of feed liquid to flow down the exterior surface of the tubes. The bottom end of each freeze tube 70 is closed.

A truncated conical shell distribution member 30 is positioned around each tube 70 in the feed liquid distribution space 52. The wider and lower end of member 30 is welded to bottom 46 around hole 72 and the narrower and upper end of member 30 is welded to the lower side of tube sheet 50. The member 30 is provided with holes 34 as already described above. The operation of member 30 is as already described except that in this embodiment it is used to form a falling film of feed liquid, instead of a falling film of refrigerant, on the exterior of the tube.

Tubes 74 are joined at their upper ends to upper tube sheet 58. Tubes 74 extend downwardly inside, and end near the bottom of, freeze tubes 70. Spacers 76 maintain tubes 74 centrally located in tubes 74.

Feed liquid is supplied to feed liquid box space 52 by conduit 78 and the excess liquid is removed therefrom by conduit 80 and recycled.

When liquefied refrigerant is supplied by conduit 66 to upper space 62, the refrigerant flows down tubes 74 and into tubes 70 thereby filling them and at least part of the lower space 64. As feed liquid flows out holes 34 in distribution members 30 and down the exterior surface of freeze tubes 70, it is cooled by heat exchange. When an aqueous feed liquid is being treated, ice crystals form in the liquid before it falls off the end of the freeze tubes into a collecting tank. The ice slurry can be separated from the concentrated liquid and be either used or discarded depending on the product desired from the concentration process. The liquid can be recycled for further concentration.

The foregoing detailed description has been given for clearness of understanding only, and no unnecessary limitations should be understood therefrom, as modifications will be obvious to those skilled in the art.

What is claimed is:

1. A falling film heat exchanger comprising:

a shell connected to vertically spaced apart horizontally arranged circular upper and lower tube sheets;

a plurality of vertically positioned parallel tubes, with each tube extending through and sealingly connected to a hole in each tube sheet;

a circular distribution plate spaced below the upper tube sheet and sealingly connected to the shell defining a heat exchange liquid distribution space, with said parallel tubes extending through oversized holes in the distribution plate;

a heat exchange liquid distribution member surrounding each tube in the distribution space joined at a lower end to the distribution plate around said oversized hole and means preventing liquid from flowing between the member upper end and the tube, said member having means which directs liquid, in the distribution space, against the tube external wall and permits flow of liquid to the tube external wall only from said member;

means to feed a heat exchange liquid to the distribution space and means to withdraw the heat exchange liquid from the shell side of the heat exchanger above the lower tube sheet; and a feed liquid distribution box positioned above the upper tube sheet and means to deliver a feed liquid to the liquid distribution box.

2. A falling film heat exchanger according to claim 1 in which the member which directs liquid to the tube internal wall includes a plurality of spaced apart holes in the member which are sized so that the downwardly flowing liquid spreads out and distributes as a continuous liquid layer on the tube internal wall.

3. A falling film heat exchanger according to claim 2 in which the heat exchange liquid distribution member is a truncated conical shell having its upper end sealingly joined to the upper tube sheet.

4. A falling film heat exchanger according to claim 2 in which the holes are at an angle of about 0° to 80° measured from a plane horizontal to the tube axis.

5. A falling film heat exchanger according to claim 4 in which the angle is 20° to 80°.

6. A falling film heat exchanger according to claim 4 in which the angle is 40° to 70°.

* * * * *